US005827158A

United States Patent [19]

Drecksel

[11] Patent Number: 5,827,158

[45] Date of Patent: Oct. 27, 1998

[54] GLIDER RESISTANCE APPARATUS

[76] Inventor: Jeremy Drecksel, 4646 S. Quail Park Dr., Holladay, Utah 84117

[21] Appl. No.: 598,459

[22] Filed: Feb. 8, 1996

[51] Int. Cl.[6] ..... A63B 69/06

[52] U.S. Cl. ..... 482/96; 482/95; 482/72

[58] Field of Search ..... 482/95, 96, 72, 482/137, 57

[56] References Cited

U.S. PATENT DOCUMENTS

| | | | |
|---|---|---|---|
| 2,252,156 | 8/1941 | Bell | 74/99 |
| 2,455,548 | 12/1948 | Bell | 272/79 |
| 2,642,288 | 6/1953 | Bell | 272/79 |
| 2,924,456 | 2/1960 | Miller | 272/79 |
| 5,108,095 | 4/1992 | Nichols | 482/137 |
| 5,178,599 | 1/1993 | Scott | 482/137 |
| 5,356,358 | 10/1994 | Chen | 482/96 |
| 5,370,594 | 12/1994 | Grinblat | 482/72 |
| 5,421,795 | 6/1995 | Chen | 482/96 |
| 5,429,568 | 7/1995 | Chen | 482/96 |
| 5,453,066 | 9/1995 | Richter, Jr. | 482/96 |

*Primary Examiner*—Jerome Donnelly
*Attorney, Agent, or Firm*—Madson & Metcalf

[57] ABSTRACT

Glider exercise machines now popular as aerobic exercising devices engaging muscle groups of both the upper and lower body are improved to provide anaerobic exercise, and aerobic workouts for users in excellent physical condition. Apparatus designed to provide more than the leveraged body weight of a user may include deadweights attached below the seat of a user. In certain embodiments, a glider may have a mechanical resistor positioned between the beam supporting the seat, and the lever lifting the beam away from the frame in response to actuation by a user pulling on handlebars and stepping on pedals. Resistors may also be connected between parts of the moveable assembly. Resistors may include hydraulic dashpots, springs, elastic straps, gas cylinders, and the like, secured between a stationary frame and a selected part of a moveable assembly, such as, for example, the beam supporting the seat or saddle, the lever lifting the seat, or the lever attached to the handlebar.

7 Claims, 4 Drawing Sheets

GLIDER RESISTANCE APPARATUS

BACKGROUND

1. The Field of the Invention

This invention relates to exercise machines and more specifically to resistance assemblies for use in glider-type riding exercise machines.

2. The Background Art

Exercise machines on which a user may ride have traditionally included exercise bicycles. However, upper body exercise and coordinated upper and lower body exercise have resulted in the development of gliders. Gliders typically rely on reciprocating motion. By contrast, exercise bicycles rely on monotonic motion in a single direction. A glider machine has been developed that provides an aerobic workout for a user.

Most gliders use some fraction of a user's body weight as the resistance. Thus, a user on a seat typically extends and retracts the arms holding onto a handlebar while oppositely retracting and extending the legs against a foot lever. Linkages provide for raising the seat of a user in response to movement of the handlebar and foot levers.

The proportion of a user's body weight is determined by the various linkages, levers, relative lengths of first, second, or third degree levers, and the like.

Some gliders also provide for a trolley supporting a user. The trolley may move backward and forward as a user is lifted up and set back down by the seat.

However, a glider is often inadequate for strength training. Moreover, an individual who has achieved substantial strength may find a typical aerobic glider inadequate for obtaining even an aerobic workout. That is, a strong user may need more resistance than his or her own body weight or a particular proportion thereof.

Also, within a home, gym, or other group-use environment, instant adjustability is desirable. That is, one user may need a substantially different resistance than another who will use the same machine a short time later. What is needed is an aerobic glider adaptable to both aerobic and strength training. Moreover, a readily adjustable glider is needed.

BRIEF SUMMARY AND OBJECTS OF THE INVENTION

In view of the foregoing, it is a primary object of the present invention to provide a strength training resistance mechanism for an aerobic glider. It is another object to provide rapidly adjustable resistance mechanisms. It is further an object to provide a glider exercise machine adaptable to both aerobic and anaerobic (strength training) exercises.

Aerobic exercise may be thought of as exercise that increases cardiovascular circulation rates and the speed of cardiopulmonary cycles. Thus the activity rate increases for the heart and lung. In aerobic exercise, which can typically be maintained for an extended period of time, the exercise can be balanced by the cardiopulmonary activity to be kept up almost indefinitely.

By contrast, anaerobic exercise requires such stress applied to involved muscles and muscle groups, that the cardiopulmonary system cannot sustain the need for oxygen and circulation. Thus, the muscles are in a transient state of performance that cannot be maintained indefinitely. After anaerobic exercise, the muscles involved must be allowed time to recover. Thus, strength training is typically characterized as anaerobic exercise, while endurance and cardiopulmonary training are typically characterized as aerobic exercise.

Consistent with the foregoing objects, and in accordance with the invention as embodied and broadly described herein, a glider is disclosed in one embodiment of the present invention as including a wide range of motion as is typical of gliders, with additional resistance mechanisms provided. The glider comprises a frame, which may have feet to stabilize the frame on a surface. A riser at one end of the frame may connect to a lateral member or inclined member extending from the riser to the other end of the frame. Each end may be provided with a base for lateral stability of the frame.

A moveable assembly may be pivotably connected to the frame for supporting a seat on which a user may be seated. A trolley connects between the lateral or incline member for lifting the seat and moving it forward toward the riser upon actuation of handle bars and foot levers by a user. The handle bar assembly and foot lever assembly together may form an actuator pivotably connected to the frame also.

Special resistance mechanisms may be connected between the trolley and the carriage frame supporting the seat. For example, weights may be added to the carriage frame. Alternatively, a dash pot or velocity-dependent hydraulic cylinder may be used to resist motion in any direction.

Alternatively, a spring loaded hydraulic cylinder, a gas spring, or a mechanical spring of suitable variety and directionality may be connected to resist motion of the carriage frame upward, downward, forward, backward, or the like. Motion of the carriage frame may be resisted with respect to the main frame of the glider, or with respect to a pivotable member of the trolley. Thus, in certain embodiments, a resistance mechanism may extend between the riser and the carriage frame, between the trolley and the carriage frame, between the principal frame of the glider and the carriage frame, or between the handle bar assembly and the principal frame.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 7, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Those of ordinary skill in the art will, of course, appreciate that various modifications to the structures of FIGS. 1–7 may easily be made without departing from the essential characteristics of the invention, as described. Thus, the following description of the details of FIGS. 1–7 is intended only by way of example, and simply illustrates certain presently preferred embodiments of the invention as claimed herein.

From the above discussion, it will be appreciated that the present invention provides a combined aerobic and anaerobic glider with a user adjustable resistance system. Resistance may be selected to be constant or graduated with the displacement of a moveable member by a user. Resistance may be proportional to the speed or distance of that displacement. Resistance may have associated inertia, or virtually none.

Figure 1:
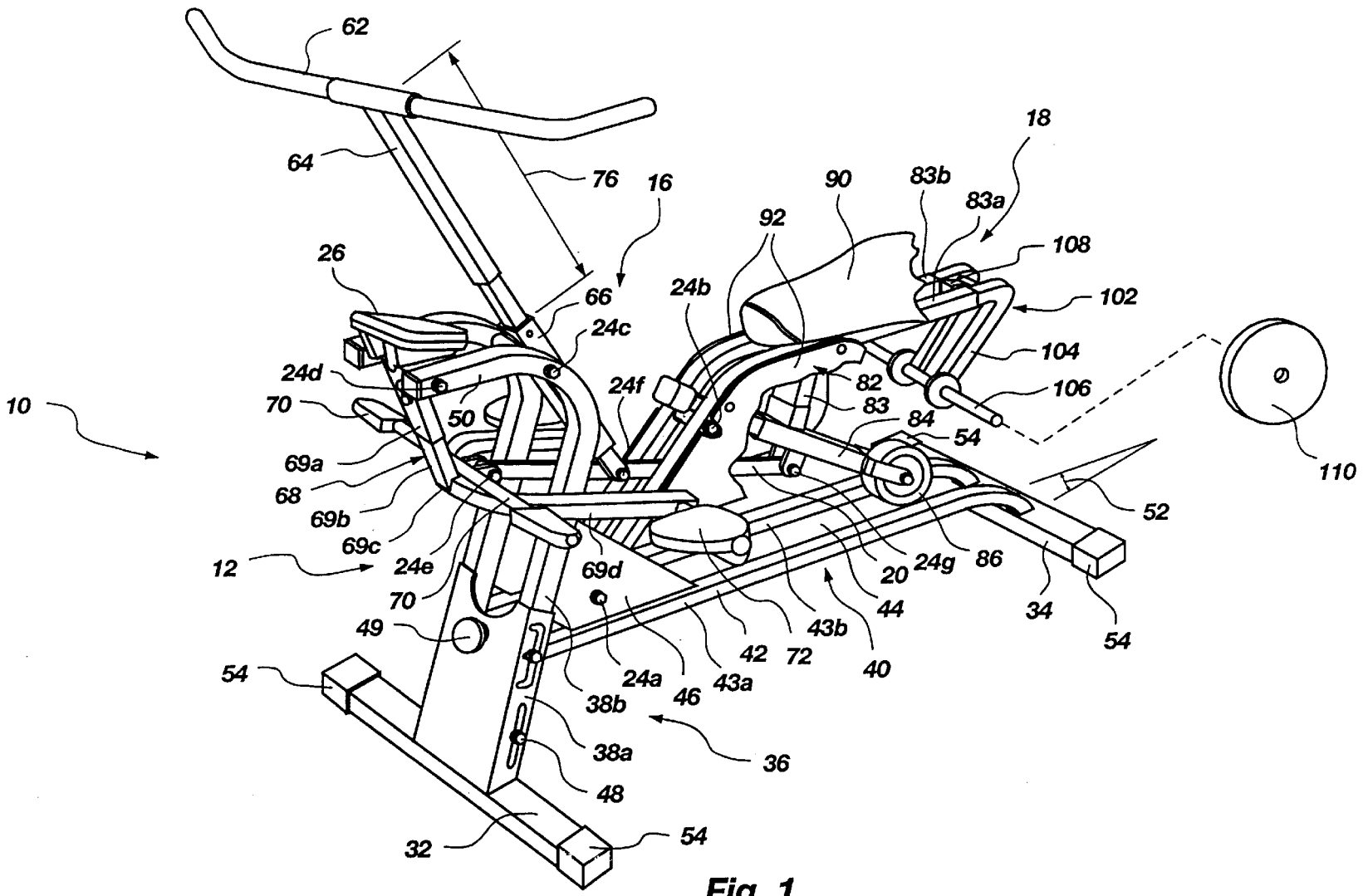
FIG. 1 is a rear quarter perspective view of a glider made in accordance with the invention.

Referring now to FIG. 1, a glider 10 may comprise a frame 12 pivotably supporting a moveable assembly 14. The moveable assembly 14 may include an actuator 16 and a carriage 18. The actuator 16 and carriage 18 may be connected directly or by a link 20 or drag link 20 for providing corresponding motion between the actuator 16 and carriage 18. The frame 12 may be provided with a console 26 for controlling or monitoring the performance of the glider 10. The frame 12, actuator 16, and carriage 18 may be pivotably connected by pivots 24*a*, 24*b*, 24*c*, 24*d*, 24*e*, 24*f*, 24*g* leverage distances may be adjusted by a variety of length adjusters 26.

The frame 12 may include a base 32 at a front 33*a*, or forward 33*a*, end with respect to a seat of a user of the glider 10 and a base 34 at the back 33*b* end of the glider 10. The frame 12 may also include a riser 36 secured to the base 32. The riser 36 may be welded, bolted, or fastened by other suitable fastener to provide a support against lateral 33*c* movement of the frame 12 on the ground or other surface, such as a floor.

The riser 36 may be comprised of a bracket 38*a* or receiver 38*a* adapted to receive an upright 38*b* extending more-or-less upwardly 33*d* from the bracket 38*a*. The upright 38*b* may be adjustable by manual, automatic, electric, pneumatic, or other mechanism providing relative upward 33*d* and downward 33*e* motion between the upright 38*b* and the bracket 38*a*.

A transverse 40 or transverse member 40 may actually be inclined or horizontal. That is, the transverse 40 may comprise a beam 42 having members 43*a*, 43*b*. A runway 44 may extend between the members 43*a*, 43*b* for supporting the moveable assembly 14. The runway 44 may be tilted to alter the effective weight of a user.

A brace 46, shown as a gusset 46 in the embodiment illustrated, may be provided to improve rigidity between the members 43*a*, 43*b* and the riser 36. The brace 46 may be above or below the transverse 40, and may be bolted, welded, or otherwise fastened to provide strength, durability, and rigidity.

Although the fasteners 48 are illustrated, with an adjustment knob 49 for securing the upright 38*b* with respect to the bracket 38*a*, other adjustment mechanisms may be relied upon. For example, a pneumatic spring, or a hydraulically actuated jack, similar to an automotive jack, may be used. Alternatively, a screw jack, or the like may be used. In one embodiment, a user may simply lift the upright 38*b* after releasing the knob 49 by either turning, pulling, pressing, or engaging some other actuation method. Upon release of the knob 49, the upright 38b may be rendered moveable, such that a user may lift the upright 38*b* in the bracket 38*a*. A second or reciprocal actuation of the knob 49 may lock the upright 38*b* with respect to the bracket 38*a*.

The head 50 at one end of the riser 36 may be readily grasped by a user for adjusting the position of the upright 38*b*. Thus, the angle 52 formed by the beam 42 with respect to a floor or other surface supporting the frame 12, may be adjusted to change the resistance experienced by a user. That is, in a glider 10, the carriage 18 may be oriented to provide a greater resistance, by inclining the beam 42. The angle 52 may control the portion of a user's body weight providing a resistance.

In certain circumstances, protection of a floor, or engagement of a floor in a manner to prevent "walking" by the glider 10 along the floor, may be important. Thus, feet 54 may be provided for the bases 32, 34. The feet 54 may be resilient, and may be formed of a material, such as a pliable polymeric composition that is unlikely to mar, or that is designed to provide friction.

The actuator 16 may include a handle bar 62 connected to an extension 64. The connection between the handle bar 62 and the extension 64 may be pivoted, and the handle bar 62 may be arranged to be straight or bowed and to be oriented to open forward, backward, or upward as desired. The extension 64 may be adapted to fit into a lever 66.

Alternatively, the extension 64 may be adapted to fit directly into the lever 84. The lever 66 may be thought of as a hand lever 66, while a foot lever 68 or lever 68 may be pivoted to the frame 12 for operation by the feet of a user.

The relative positions of the pivot points 24*c*, 24*f* compare to the pivot points 24*d*, 24*e*, respectively. Both the lever 66 and lever 68, as well as the link 20, may be used to adjust the relative motion of a user with respect to the handle bar 62 and foot rests 70. Thus, by careful selection of the relative positions of the pivots 24*c*, 24*d*, 24*e*, 24*f*, the rhombic relationship may be changed to a non-parallelogram shape. Thus, the relative positions to which arms and feet must be extended may be altered. Similarly, the proportion of resistance born by the arms and legs may be altered by providing for adjustable positions or by selectively establishing such positions. Pivots 24*a*–24*f* may be characterized as pins, or removeable pins. Thus by use of such pins or other removeable connectors, the sense (direction of movement of one point in relation to movement of another point) may be changed for levers relying on such pivots at points of either fulcrum, load, or supporting force function. Likewise, the leverage (distance between one point and a fulcrum with respect to the distance between another point and the fulcrum) may be changed. Similarly, with a system of interconnecting levers and linkages, effective leverage of the system may be altered with a change in leverage of any one lever in the system according to the rules of static force balancing.

A pedal 72 may be positioned at a location, such as an end, along the foot lever 68 to provide pivoting 69 motion for the foot. Pivoting 69 motion may provide both comfort and proper application of force by the leg.

In one embodiment, the lever 68 may be comprised of a segment 69*a* and a segment 69*b* that are moveable relative to one another by an adjustment mechanism 69*c*. Thus, the pivots 24*d* and 24*e* may be spaced further or closer apart to alter the leverage that the feet obtain against the resistance provided by the glider 10. Likewise, the adjustment mechanism 69*c* or another similar mechanism may be adapted to change the angle 74 between the segment 69*b* and the segment 69*d* of the lever 68. Again, the angle 74 provides for extension of the pedal 72 with respect to the pivot 24*d* and the pivot 24*e*. Thus, increasing the angle 74 provides for additional leverage by the legs, resulting in relatively less force and more distance associated with exercise by the legs compared to the arms operating the handle bar 62.

Likewise, the position of a user's feet and the maximum extension of a user's legs to the pedals 72 affects the relative proportion of aerobic versus strength training, as well as flexibility and comfort of a user. Thus, for example, the foot rest 70 may be coaxial with the pivot 24*e* and the segment 69*d* may be made to pivot about the conjoined pivot 24*e* and foot rest 70 to provide for adjustability of the angle 74.

Similarly, the pivot 24*f* may be moved along the link 20 through a plurality of holes, or similar connections, to position the handle bar 62 in a comfortable position with a proper extension forward 33*a* and backward 33*b* of a user's arms during operation. Likewise, the extension 64 may be adjusted upwardly 33*d* or downwardly 33*e* within the lever 66 to provide a change in the leverage of the handle bar 62 about the pivot 24*c* against the link 20 at the pivot 24*f*. Thus, the relative difficulty of a user in extending and drawing in the arms may be altered drastically by the relative leverage of the pivot 24*f* against the handle bar 62 about the pivot 24*c*. Similarly, the range of motion of the handle bar 62 forward 33*a* and backward 33*b* may be altered by the effective length 76 of the extension 64 extending from the lever 66.

The carriage 18 may include a carriage frame 82 (alternatively called a beam, lever, or frame 82) may itself be made of one or more individual beams 83*a*, 83*b*. The frame 82 or beam 82 may connect to the principal frame 12, or simply the frame 12, at a pivot 24*a* permitting an arcuate or pivoting motion by the carriage frame 82 with respect to the principal frame 12. A lever 84 may be connected to the frame 82 at a pivot 24*b*. In one embodiment, a wheel 86 may be provided to roll along a runway 44 of the beam 42 between the members 43*a*, 43*b*.

In one embodiment, a stop 88 secured to either the frame 82 or lever 84 may fix the minimum proximity of the lever 84 to the frame 82. Thus, the remainder of the carriage 18 and the frame 12 are not released to make contact as a crude stop procedure. Instead, the relative positions of the frame 82 and the lever 84 may be fixed by the stop 88 which may have a length adjuster. A seat 90 or saddle 90 may be adjustably secured to the carriage frame 82.

In one embodiment, the seat may be adjusted to move along the beams 83*a*, 83*b* for adjusting a user position with respect to the handle bar 62 and the pedals 72. Guards 92 may be provided to prevent pinching or trapping of body members of small children or of a user within the carriage 18.

One resistance mechanism for the glider 10 is a portion (according to an applicable leveraging principle) of the weight of a user seated on the saddle 90. That is, pivoting the lever 68 by the feet of a user on the pedals 72 may draw the link 20 forward, pivoting the lever 84. As the lever 84 pivots, the wheel 86 may also move forward, and the carriage frame 82 may pivot about the pivot 24*a*.

In an alternative embodiment, the lever 84 may be extensible. Likewise the position of the pivot 24*g* may be attached to be adjustable along the lever 84. Thus, a user may alter the amount of upward 33*d* motion or rise of the seat 90 with respect to the frame 12, while also altering the relative leverage that the handle bar 62 obtains against the pivot 24*g*.

An adjustment mechanism for selectively positioning the pivot 24*g* along the lever 84 may be a bracket, a latch, a pin in a slot, a threaded worm or the like for adjusting the position of the pivot 24*g*. Thus, by adjusting the leverages exerted by the handle bar 62 and pedals 72 through the lever 66 and lever 68, respectively, as well as the relative leverage of the carriage frame 82 at the pivot 24*b* against the pivot 84 and the pivot corresponding to the wheel 86, a user may vary the relative proportion of body weight that is lifted by the arms through the handle bar 62 and by the feet through the pedals 72. Moreover, a user may adjust the resistance to be greater than the actual body weight simply by altering the corresponding leverages.

Likewise, a dramatic increase in resistance may be provided while maintaining most other relative motions at the same respective positions by repositioning the pivot 24*b* along the carriage frame 82. Thus, by shortening the lever 84 and moving the pivot 24*b* toward the pivot 24*a*, the seat 90 may see exactly the same motion, and the handle bar 62 may see exactly the same motion as previously, while the resistance provided by the body weight of the person on the seat 90 may be transferred with a greater leverage into the exercise resistance.

Referring now to FIGS. 1–7, the resistance provided by the body weight of a user seated on the saddle 90 may be increased by providing a resistance frame 102. The resistance frame 102 may include a riser 104 extending to a rack 106 for holding a resistance. For example, the rack 106 may be adapted to connect to an elastic resistance, a spring, or weights. In certain embodiments, illustrated in FIGS. 4–7, the riser 104 may be connected by a fastener 108 or fastening mechanism 108(pin through aperture shown, latch shown, bolt through aperture shown with nut, etc.) or simply welded directly to the carriage frame 82 in any convenient shape. For example, any of the shapes of FIGS. 4–7 may be welded directly to the moveable assembly 14 in an appropriate location. The weights 110 may then be placed on the rack 106 and secured, for example with a collar 111 or other securement device. Thus, a user has effectively increased his or her effective body weight by adding the deadweights 110.

Deadweights 110 may also be referred to as inertial resistances. That is, inertial resistances will resist not only lifting, due to gravity, but any motion or stopping, in any direction, due to their inertia. Elastic members and fluid damping apparatus cannot typically provide significant inertia. Significant mass is required.

Figure 7:
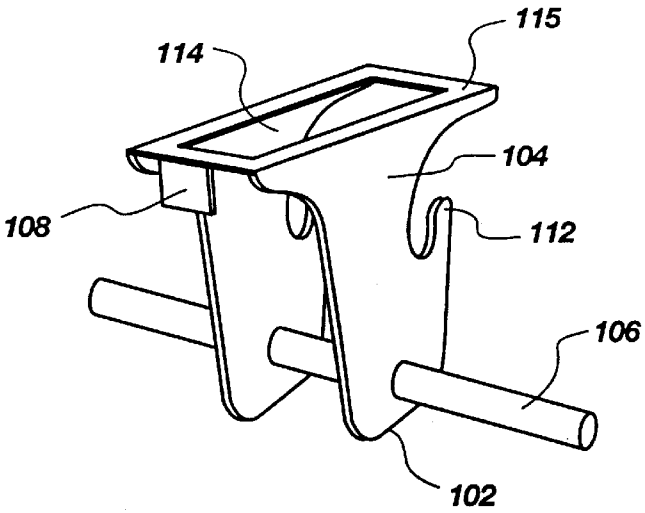
FIG. 7 is a right rear perspective view of an alternative embodiment of a weight frame for attachment to the apparatus of FIG. 1.
Figure 4:
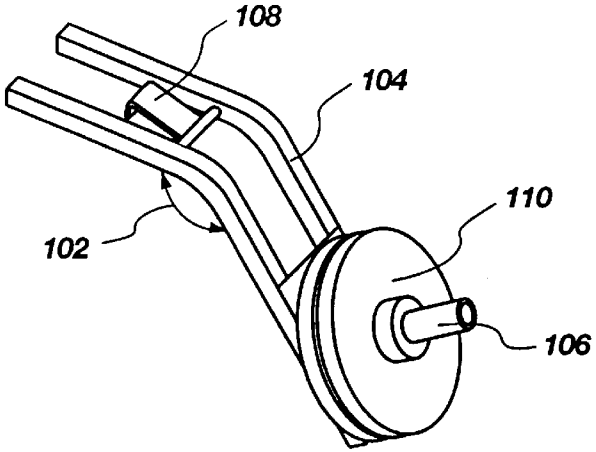
FIG. 4 is a rear quarter perspective view of a resistance frame and weight assembly for attachment to the apparatus of FIG. 1.
Figure 6:
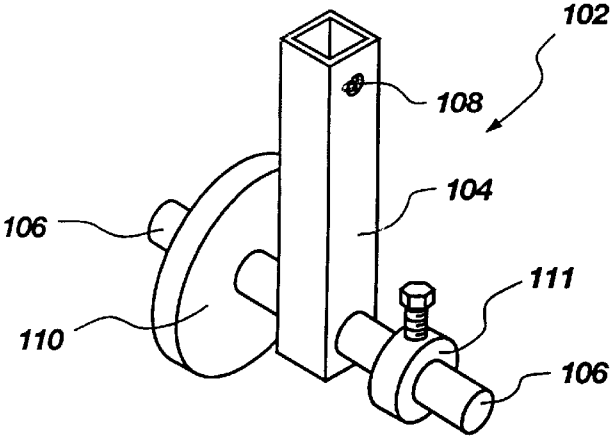
FIG. 6 is a right rear perspective view of an alternative embodiment of a weight frame for attachment to the apparatus of FIG. 1.

Similarly, in the embodiment of FIG. 7, a hook 112 may be provided for holding a dumbbell. An aperture 114 may be formed in a top plate 115 of the frame 102 in order to accommodate adjustability of a seat 90 in a forward and backward direction.

One advantage of the weights 110 is an increase of resistance against motion of the levers 66, 68 by a user, while providing inertia. Thus, to the extent that the weights 110 are put in motion, they will continue in motion until their kinetic energy is overcome by a corresponding rise or opposing force.

Figure 2:
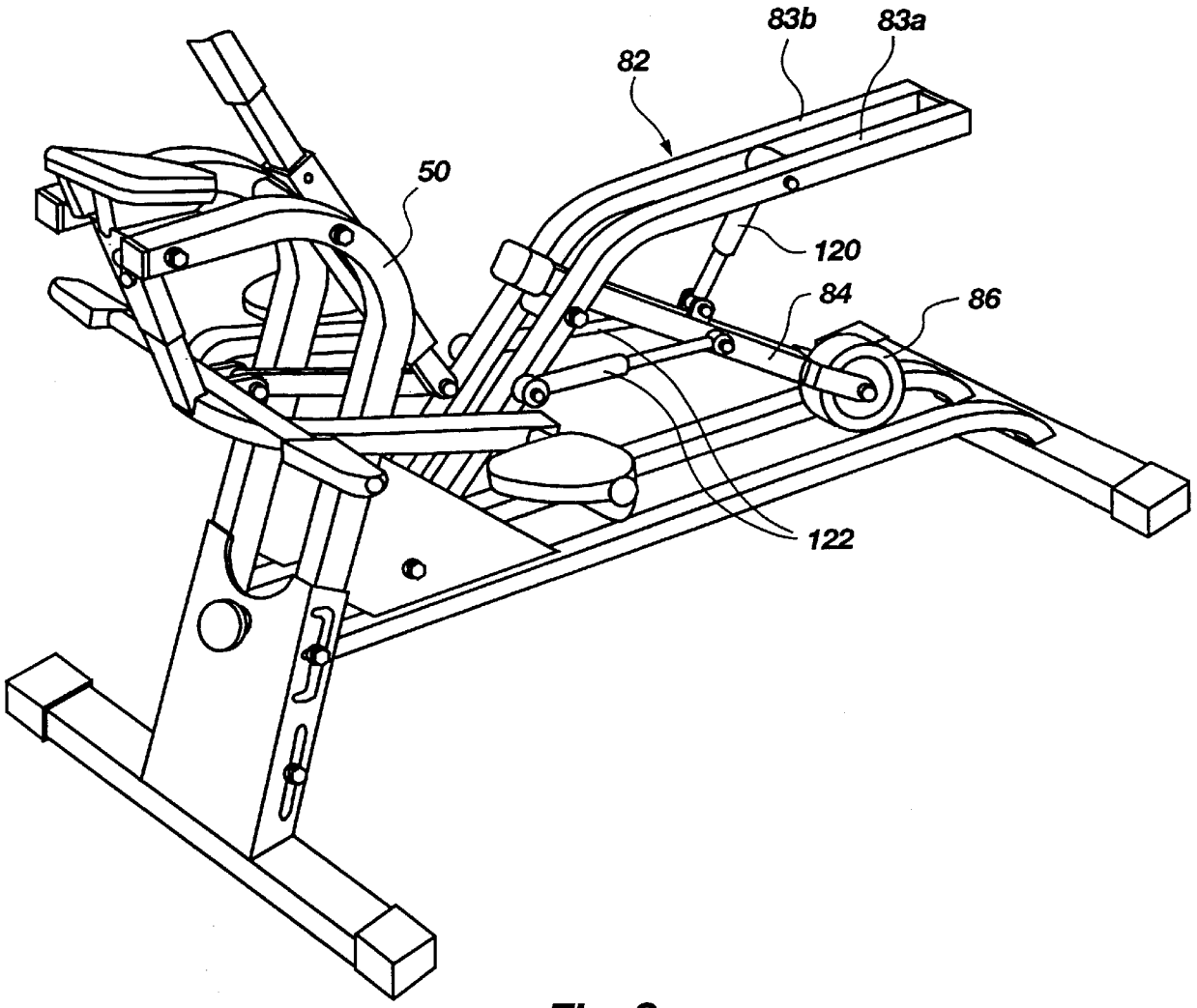
FIG. 2 is a rear quarter perspective view of damping and spring resistance mechanisms connected to the carriage frame.
Figure 3:
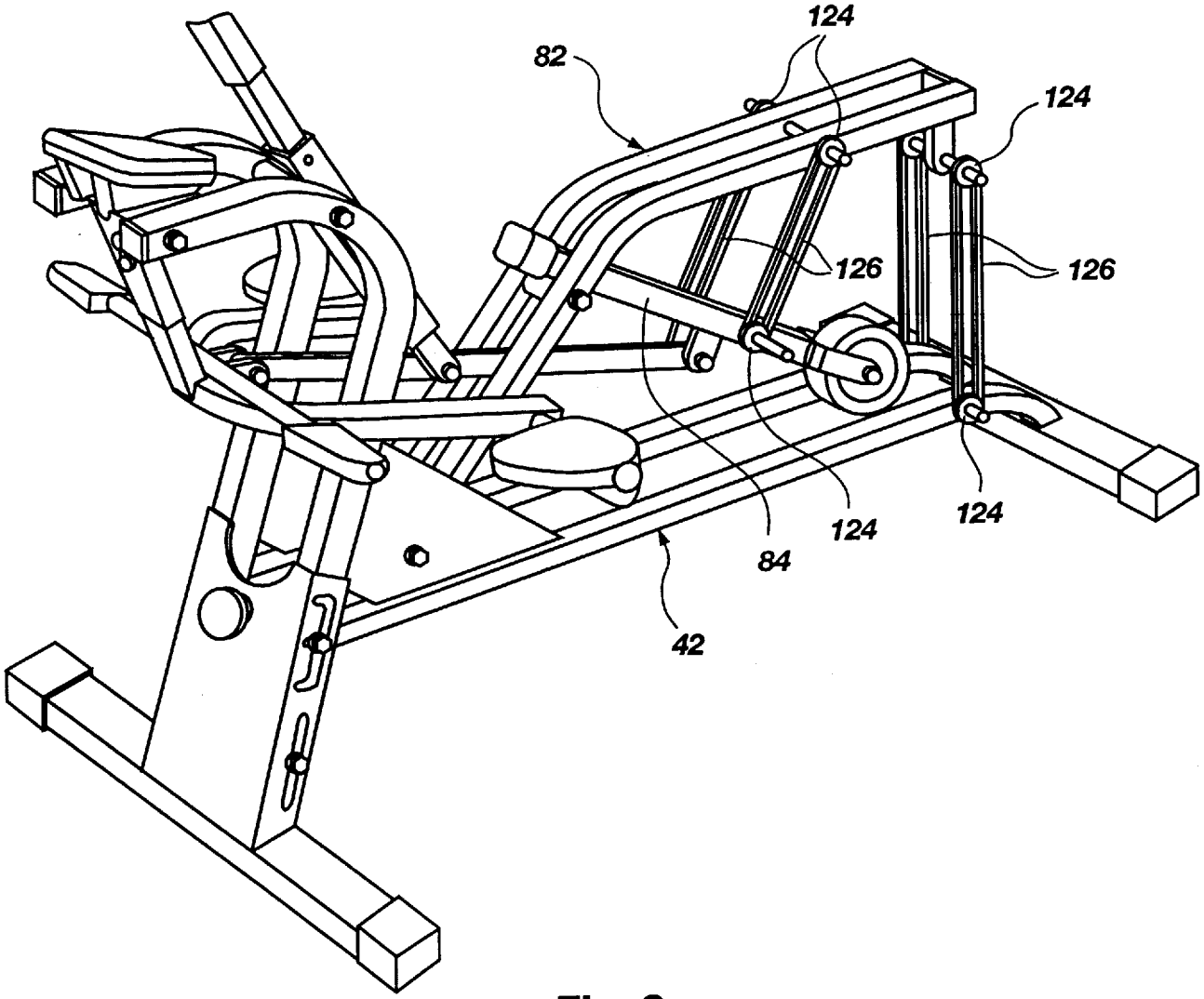
FIG. 3 is a rear quarter perspective view of the apparatus of FIG. 1 showing alternative embodiments of elastic resistance bands.
Figure 5:
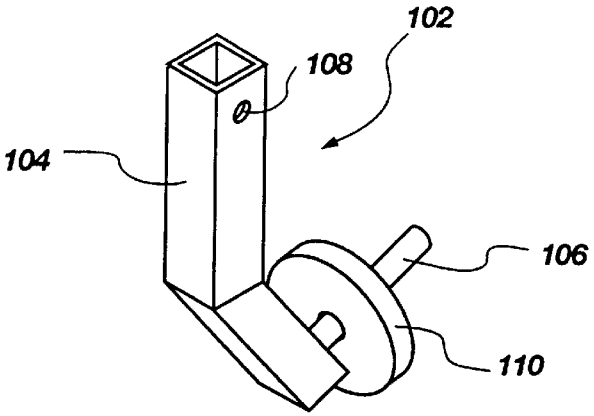
FIG. 5 is a rear quarter perspective view of an alternative embodiment of a weight frame for connection to the apparatus of FIG. 1.

However, the embodiments of FIGS. 2 and 3 illustrate other resistance mechanisms. For example, the resistor 120 may comprise a hydraulic dashpot for resisting motion in an amount proportional to the velocity of motion. Thus, the motion may be characterized by the "characteristic velocity" of the damping element in a dashpot or hydraulic damping cylinder.

However, levers connected to such resistors 120 displace proportionately with respect to the moveable end of a resistor 120 or an internal damping element. A velocity of an appropriate lever end or pivot point may, therefore, be selected as a "characteristic velocity" relating to the resistance or drag of the resistor 120. The resistor 120 may also act as a shock absorber as a user settles back to a downward 33*e* position of the saddle 90. Likewise, whether moving forward 33*a* or backward 33*b*, a user may experience a resistance provided by a resistor 120 or dashpot 120.

A user may obtain a proportionally higher resistance by increasing speed of motion against a dashpot or distance against a spring. That is, lifting weights 110 does not of itself change resistance with speed or distance. However, changing the speed of the feet against the pedals 72, or of the arms against the handle bar 62, may dramatically affect the resistance provided by the resistor 120 if the resistor 120 uses some form of fluid dynamic drag.

By contrast, changing the stroke (distance or displacement) of a spring changes resistance according to Hooke's law. As with a characteristic velocity, a "characteristic displacement" may be defined as the movement of a moveable end of a Hookean device. However, as stated with respect to velocities in a system of interconnected levers, a characteristic displacement may be taken from any point that displaces proportionately to the moveable portion of a Hookean device. In general, a Hookean device may be thought of as an elastically deformable or displaceable member, displacing without permanent deformation.

If a resistor 122 (which may be identical to, in addition to, or in place of a resistor 120) is placed as illustrated in FIG. 2, a compression or tension spring may be provided within the resistor 122. Likewise, an air spring or a steel spring may be used. Elastomeric springs may be suitable, if properly protected against breakage or possible injurious trajectories. Thus, a resistor 120 may act in compression or tension, and may operate proportionately with velocity or displacement of a moveable end or moveable element.

In general, the resistor 120 may move out of phase with the resistor 122. Thus, the resistors 122 may be used in combination with a resistor 120, or the resistor 120 may be used independently of the resistors 122. The resistors 122 are shown in duplicate, but may be used singly, and in combination with the resistor 120. Likewise, the resistor 120 may be used singly or in duplicate or in combination with the resistor 122.

The resistor 122 may include a dashpot-or damper-type of resistor. The resistor 120 may require a Hookean resistance to operate in an extending mode, rather than in a compressing mode. That is, it may be desirable for the resistor 120 to provide resistance as the lever 84 moves away from the carriage frame 82. By contrast, it may be desirable that the resistor 122 provide resistance as the lever 84 moves toward the carriage frame along the resistors' 120, 122 respective longitudinal directions.

In one alternative embodiment, illustrated in FIG. 3, resistance may be provided by an elastic band 126 connected, for example, by a spool to either the rack 106 or pins 128. The elastic bands 126 may be connected between the lever 84 and the carriage frame 82, between the carriage frame 82 and the frame 12, between the rack 106 and the lever 84, or between the rack 106 and the frame 12.

One advantage of connecting between the rack 106 and the frame 12 is large resistances over long distances. By contrast, less extension may be experienced by a band 126 connected between the lever 84 and the carriage frame 82, as illustrated in FIG. 2. Similarly, the elastic band 126 may obtain substantially more leverage against a user, if connected between the rack 106 and the frame 112, as illustrated in FIG. 2.

By contrast, both the leverage and the extension, and thus the comparative force for an elastic band 126 of the same resistance value or elastic constant (with respect to Hooke's law), may be less with the elastic band 126 connected between the lever 84 and the carriage frame 82. A combination of the foregoing options may also be used.

OPERATION

In operation, a user may select the resistance sources and the levels of resistance. For example, a user may extend the riser 38*b* with respect to the bracket 38*a*, thus changing the relative body weight lifted along an inclined runway 44.

A user may also adjust the length of the lever 68 by adjusting the adjustment mechanism 69*c* to provide telescoping of the segment 69*a*, 69*b*, as well as an angular position 74 of the segment 69*d*. The user may then determine whether to place the extension 64 in the lever 84 or in the lever 64. The relative length 76 of the extension 64 may be adjusted for an appropriate range of motion and comparative resistance.

The position of the pivot 24*g* may be adjusted, or, in one embodiment, the length of the lever 84 may be adjusted by telescoping the lever 84, and automatically adjusting the position of the pivot 24*g*.

Adjusting the lever 84 to place the wheel 86 closer to the pivot 24*a* may provide for greater resistance to a user while maintaining the total range of motion of the seat 90 at the same range.

Weights 110 may be added to any of the racks 106. Similarly, elastic bands 126 may then be connected to any of the pins 128 as desired. Of course, a user may use one or a combination of resistances. Meanwhile, a glider 10 may be manufactured with one or a plurality of resistance mechanisms identified herein. Moreover, the pins 128 may be removable to be positioned by a user along the carriage frame 18 or lever 84, or both.

A user may be seated on the saddle 90 with the feet placed on the pedals 72 or on the foot rests 70. The foot rests 70 provide less leverage advantage, and thus add relatively greater resistance and a shorter stroke for a user. However, the pedals 72 provide a relatively greater range of motions for the legs. A user may then proceed to extend the legs against the pedals 72 or foot rests 70, while drawing the handle bars 62 toward the seat 90 with the arms. Reversing this motion may provide resistance if the dashpot 120 is used. Otherwise, the link 20 could be connected to the lever 66 at the pivot 24*c* free of the frame. In this configuration, the pivot 24 for the lever 66 would be fixed to pivot on a single axis on the frame 12. Thus, a user could obtain resistance by pushing the handlebar 62 instead of by pulling.

In one embodiment, the pivot 24*e* of the lever 68 may be connected to the pivot 24*e* of the link 20, pivoting about a single axis fixed to the frame 12 below the head 50. The pivot 24*e* of the link 20 may be connected to translate freely with the pivot 24*c* of the lever 66 or the pivot 24*d*, free of the head 50. That is, the nature of the levers 66, 68 may be reversed such that pushing the handle bar 62 away from the body of a user actually is required. Thus, for example, triceps, (rather than biceps), in the arms may be exercised to lift the body. Similarly, the legs of a user, by inclusion of suitable cages or traps such as those used by bicycle riders and rowers, or on rowing exercise machines, may pull rather than push the lever 68.

Several alternatives may also be clarified with respect to structures and use of the glider 10. Referring to FIG. 1, one may note that the glider 10 may be in a "rest position" when a user is seated, but the lever 66 is not displaced by a user. In an alternative embodiment, discussed above, the pivot points 24*a*–24*f* may be connected to one another such that the rest position would result in the handlebar 62 being positioned closest to the user with the pedals 72 at a maximum displacement from the seat 90. In yet another alternative embodiment, the neutral or rest position may correspond to both the pedals 62 and the handlebar 62 being at their respective minimum distances from the seat 90, so that each must be pushed to operate the glider 10.

As described above, variations of relative motion of the handlebar 62 and pedals 72 may be accomplished by changing associated levers from primary to secondary or to tertiary or vice versa, or any combination, as required. Primary levers may have a fulcrum between a load at one effective end of a beam of a lever, and a supporting force applied in the same direction as the load at an opposite effective end of the beam. Secondary levers may have a fulcrum at one end of a lever and the supporting force at the other end, each acting in the same direction, with the load between acting in an opposite direction. By "end" may be meant effective end, since any inactive or unloaded length of a lever may be meaningless, if not acting as part of a lever. Tertiary levers may have a fulcrum at one end, acting in the same direction as a load at the other end, while the supporting force may be positioned between the ends to act opposite both the fulcrum and the load cantilevered at an end opposite the fulcrum.

Each of the pivots 24*a*–24*f* may be moved with respect to one another by inclusion of an adjustment to alter the length of a member extending therebetween. Likewise, the sense of any lever may be altered by connecting the members loading or supporting the load to opposite locations. That is, for example, moving a load along a lever (across the fulcrum) to convert a primary lever to a secondary lever, without changing the direction of the load, changes the direction in which the supporting force must be applied.

Likewise, changing the distance (characteristic length) between a load and a fulcrum or between a supporting force and a fulcrum changes the leverage advantage between the load and the supporting force. This also changes the length of the respective arcs swept by the load end and the supporting force end of the lever.

One may note that in fluid mechanics the drag force is presented by an object passing through a fluid or a fluid passing through a restriction. In a dashpot, in general, a hydraulic damping cylinder, or the like, the drag force may be proportional to the relative velocities of the fixed and moveable members. Likewise, a device operating according to Hooke's law will exert a force proportional to the relative positions of the fixed and moveable members.

In general, a handlebar 62, foot rest 70, and pedal 72 may be characterized as actuators. Each may be the element of interaction between a user and a moveable member such as a lever (e.g. levers 66, 68).

In certain embodiments, an apparatus 10 may be linked such that the beam 82 is not supported by a lever 84 and wheel 86. The lever 64 or the drag link 20 may act directly on the carriage frame 82 or beam 82 to lift the beam 82 and saddle 90. However a different but suitable leverage advantage may be obtained by the lever 64 by acting on the lever 84 to indirectly lift the carriage frame 82.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A glider adaptable to aerobic and anaerobic exercising by a user, the glider comprising:

a principal frame positionable on a surface, the frame comprising a runway between a front end and a back end;

a moveable assembly comprising:

a first beam, said beam having first and second ends and being pivotably connected proximate a first end thereof to the front end of the principal frame, to allow pivotal movement of the second end of the first beam upwardly in an arcuate path, a seat attached to the second end of the first beam to move rigidly and arcuately with the first beam upon pivoting, a first lever, having upper and lower ends, moveable with respect to the principal frame and resisted by a first resistance corresponding to the weight of a user, leveraged by the moveable assembly, the first lever being pivotably connected proximate the upper end thereof to the first beam, being adapted at the lower end to translate along the runway, and having a connector intermediate the upper and lower ends;

a second lever having proximal and distal ends, said lever having an actuator proximate the proximal end thereof for operation by a user, the second lever being pivotably connected proximate the distal end to the principal frame at a first pivot, and having a drag link pivotally connected between the second lever, at a location spaced from the first pivot, and the connector the first lever; and a rack, the rack being adapted to selectively receive deadweights and being rigidly connected proximate the end of the first beam to pivot therewith about a single, common center of rotation, for resisting motion of the moveable assembly.

2. The glider of claim 1, wherein the rack is further provided with deadweights attached to the rack while effectively maintaining the effective center of mass, with respect to the common center of rotation, of the moveable assembly.

3. The glider of claim 1, wherein the rack is further adapted to alter the effective center of mass of the moveable assembly about the single, common center of rotation.

4. The glider of claim 1, wherein the rack further comprises a riser extending between the first beam and the rack to space the rack from the seat.

5. The glider of claim 4 wherein the rack comprises a hook formed to hold a dumbbell as a deadweight.

6. The glider of claim 1 wherein the rack is adapted to be selectively removable and attachable to the moveable assembly.

7. The glider of claim 1, wherein the rack further comprises an adjustment structure for adjusting the weights at a value effective to provide anaerobic exercise for a user.

* * * * *